US006203331B1

(12) United States Patent
McHugh et al.

(10) Patent No.: US 6,203,331 B1
(45) Date of Patent: Mar. 20, 2001

(54) LAND GRID ARRAY CONNECTOR HAVING A FLOATING HOUSING

(75) Inventors: Robert G. McHugh, Evergreen, CO (US); Nick Lin, Hsin-Chuang (TW); Hanchen Tan, Alameda, CA (US); Jwomin Wang, Hsin-Dan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/434,827

(22) Filed: Nov. 5, 1999

(51) Int. Cl.[7] ..... H01R 12/00
(52) U.S. Cl. ..... 439/71; 439/66; 439/246
(58) Field of Search ..... 439/66, 71, 83, 439/246, 247, 248

(56) References Cited

U.S. PATENT DOCUMENTS 5,378,160 * 1/1995 Yumibe et al. ..... 439/66
5,653,598 * 8/1997 Grabbe ..... 439/66
5,984,693 * 11/1999 McHugh et al. ..... 439/66

* cited by examiner

*Primary Examiner*—Gary F. Paumen
(74) *Attorney, Agent, or Firm*—Wei Te Chung

(57) ABSTRACT

A connector comprises an insulative housing in which a plurality of passageways are defined. A plurality of contacts are received in the passageways. Each contact comprises an engagement plate loosely retained in the passageway, a positioning section connected to the engagement plate via a first flexible neck and mounted thereon a solder ball, a contacting section located above the positioning section and connected to the positioning section via a second flexible neck. When the solder ball is soldered on a printed circuit board and the housing and the contact is urged by an external electrical device, the housing is moved downward with respect to the engagement plate of the contact and the contacting section is pressed downward by the external electrical device, with the second flexible neck being deformed for providing a normal force facilitating the contacting section to abut against the external electrical device.

3 Claims, 7 Drawing Sheets

LAND GRID ARRAY CONNECTOR HAVING A FLOATING HOUSING

BACKGROUND OF THE INVENTION

1. Field of the Invention

The present invention relates to a land grid array (LGA) connector for electrically connecting a CPU to a printed circuit board, especially an LGA connector in which contacts and a housing for retaining the contacts are retained in a floating relation so that when the housing and the contacts are urged by an external device, the housing may be moved relative to the contacts.

2. The Prior Art

Land grid array (LGA) connectors are commonly used with IC packages and do not require soldering procedures during engagement between the LGA connector and a related printed circuit board (PCB). Normally, an LGA assembly includes an IC package, such as a CPU package, having a plurality of flat contact pads formed on a bottom surface thereof, a connector having an insulative housing and defining a plurality of passageways therethrough, and a plurality of conductive contacts received in the passageways of the connector. Fastening means comprises a top plate positioned on a top surface of the IC package, a bottom plate positioned on a bottom surface of the PCB, and a plurality of sets of aligned holes defined through the PCB. The fastening means is used to configure the assembly. Each set of aligned holes receives a screw therein which engages with a washer and a nut thereby sandwiching the LGA assembly between the top and bottom plates of the fastening means.

U.S. Pat. No. 5,653,598 discloses an electrical contact for use in a connector 30 between mutually opposed electrical interfaces 40, 99 such as contact pads respectively formed on an IC package 2 and a printed circuit board 9, as shown in FIG. 10. The conventional contact comprises a generally planar contact body 10 having first and second major faces 110, 120. The body includes a pair of spaced apart spring arms 140, 150 connected by a resilient bight portion 160. The spring arms 140, 150 each have a free end with an outwardly facing edge forming a contact nose 17, 18 for engaging with the corresponding interface 40, 99. Shorting sections 19, 20 generally extend toward each other from the free ends and are offset such that, upon deflection of the spring arms 140, 150 toward each other, the shorting sections 19, 20 overlap and the first major face 110 engages the second major face 120. Thus, a shortened electrical path is formed between the contact noses 17, 18 when the package 2 is urged against the connector 30.

With the conventional LGA connector, the shorting sections 19, 20 may not properly contact each other due to unwanted lateral deflection thereof when the bight of the contact is deformed. Moreover, an additional contact resistance exists between the shorting sections 19, 20 thereby adversely affecting the signal transmission.

Additionally, the conventional LGA connector is in advance fixed in a motherboard via screws in a pre-assembly procedure. In a final assembly procedure, the screws have to be released first and then fastened for urging the CPU to the LGA connector. Therefore, in the total assembly procedure, the screws have to be fastened, released, and fastened again. This is cumbersome and not accepted by most mother board manufacturers.

Moreover, due to a low profile requirement, the housing which receives the contacts is made thinner, and is apt to be warped. This warped housing may block some of the contacts from being effectively contacted by the IC package which urges the LGA connector. Therefore, the ineffectively contacted problem due to the warped housing is to be solved earnestly. It is requisite to provide a new LGA connector for solving the above problems.

SUMMARY OF THE INVENTION

The primary purpose of the present invention is to provide a new LGA connector which can solve ineffective contacting problem due to warpage of a housing thereof.

In accordance with one aspect of the present invention, an land grid array connector comprises an insulative housing in which a plurality of passageways are defined. A plurality of contacts are received in the passageways. Each contact comprises an engagement plate loosely retained in the passageway, a positioning section connected to the engagement plate via a first flexible neck and mounted thereon a solder ball, a contacting section located above the positioning section and connected to the positioning section via a second flexible neck. When the solder ball is soldered on a printed circuit board and the housing and the contact is urged by an external electrical device, the housing is moved downward with respect to the engagement plate of the contact and the contacting section is pressed downward by the external electrical device, with the second flexible neck being deformed for providing a normal force facilitating the contacting section to abut against the external electrical device.

DETAILED DESCRIPTION OF THE PREFERRED EMBODIMENT

Figure 1:
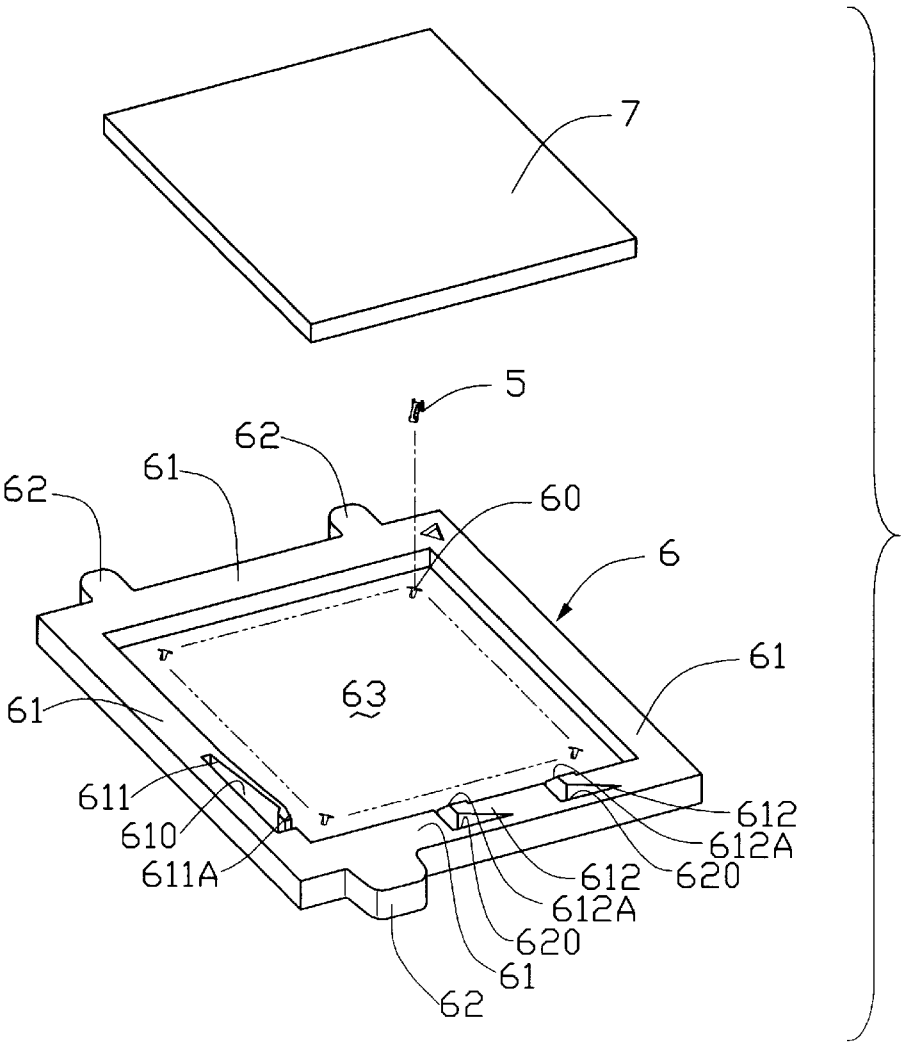
FIG. 1 is an LGA connector in accordance with the present invention for receiving a CPU package.
Figure 2:
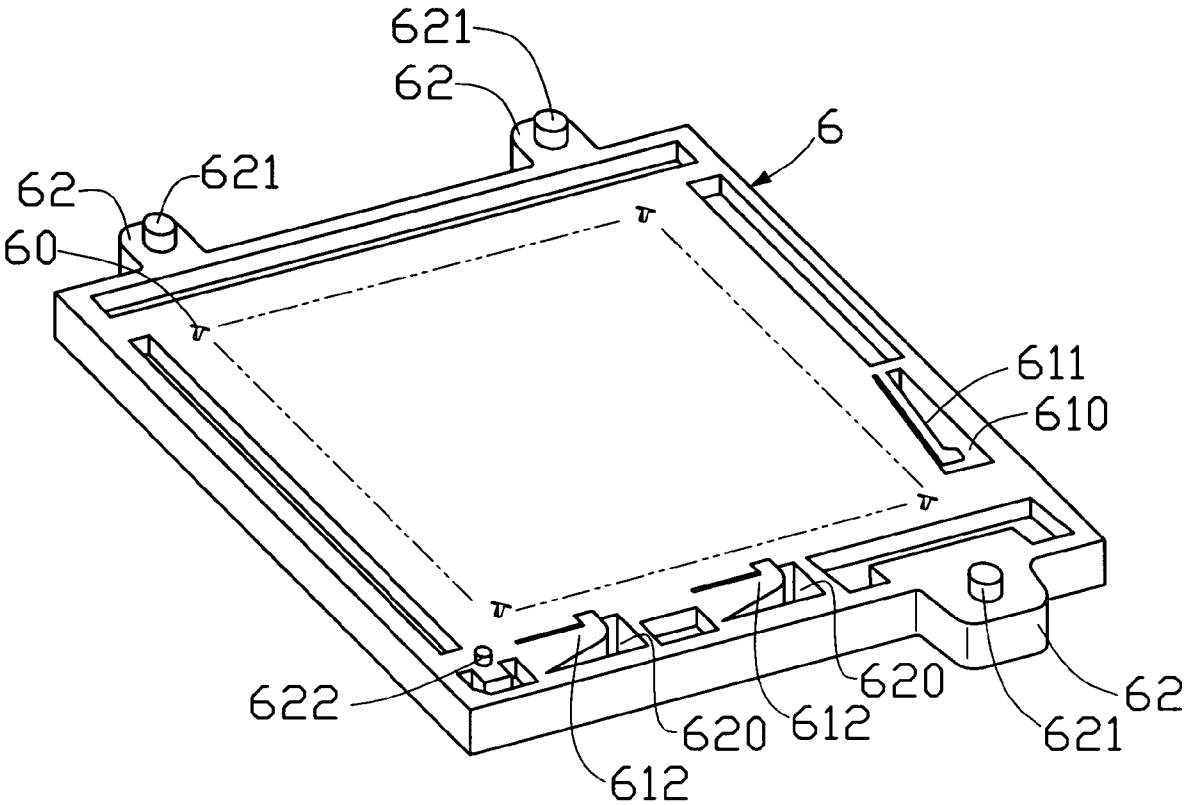
FIG. 2 is a perspective view of the LGA connector of FIG. 1 taken from an opposite direction.

Referring to FIGS. 1 and 2, a connector in accordance with the present invention comprises an insulative housing 6 defining a plurality of passageways 60 therein for receiving contacts 5. The housing 6 is substantially a body having four raised sides 61 and a central cavity 63 defined between the four raised sides 61 and sized to receive an IC package such as a CPU package 7. The passageways 60 are defined through a bottom surface of the central cavity 63. The contact 5 is received in each of the passageways 60. A first resilient arm 611 is formed in one of the four raised sides 61 and capable of deformation in a first space 610 defined in the raised side 61. Two second resilient arms 612 are formed in another raised side 61 adjacent to the one in which the first resilient arm 611 is formed. The second resilient arm 612 is capable of deformation in a second space 620 defined in the raised side 61. The first resilient arm 611 and the second resilient arms 612 each have a chamfer surface 611A, 612A respectively formed in an upper edge thereof for guiding insertion of the CPU package 7 to the central cavity 63. The CPU package 7 is fixed in the cavity 63 by normal force originated from the deformation of the resilient arms 611, 612. Three ears 62 extend from opposite raised sides 61 near three corner of the housing 6 and each ear 62 has a post 621 extending downward for engagement within openings (not shown) of a printed circuit board 9 (see FIG. 6). Similarly, an additional post 622 extending from the bottom of the housing 6 near another corner thereof for engagement within another opening (not shown) of the printed circuit board 9.

Figure 4:
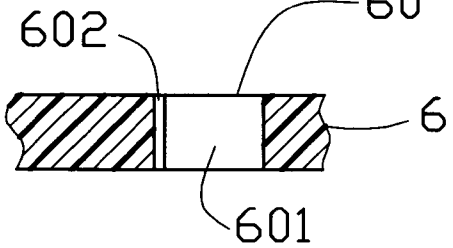
FIG. 4 is a cross-sectional view taken from line 4—4 of FIG. 3.
Figure 3:
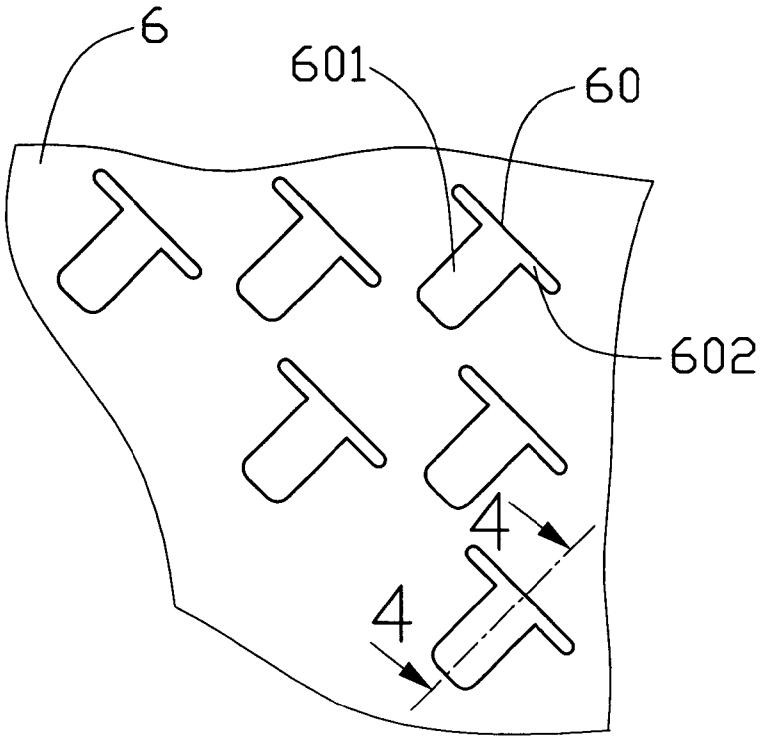
FIG. 3 is an enlarged top view of several passageways of FIG. 1.

Referring to FIGS. 3 and 4, each passageway 60 has a T-shape in cross-section and comprises a longitudinal hole 601 and a lateral hole 602 communicating with and perpendicular to the longitudinal hole 601. The longitudinal hole 601 is wider than the lateral hole 602.

Figure 5:
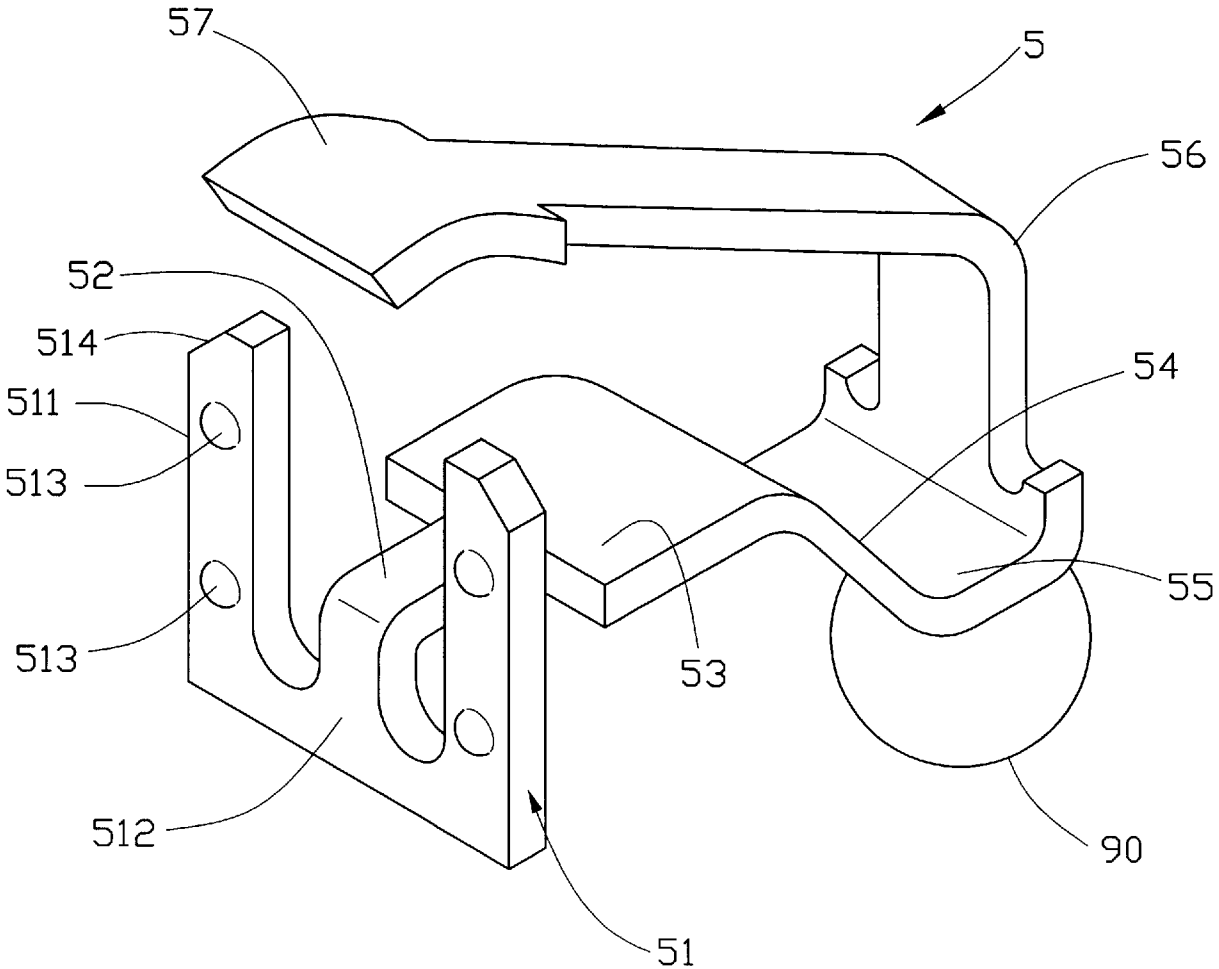
FIG. 5 is an enlarged perspective view of the contact shown in FIG. 1.
Figure 6:
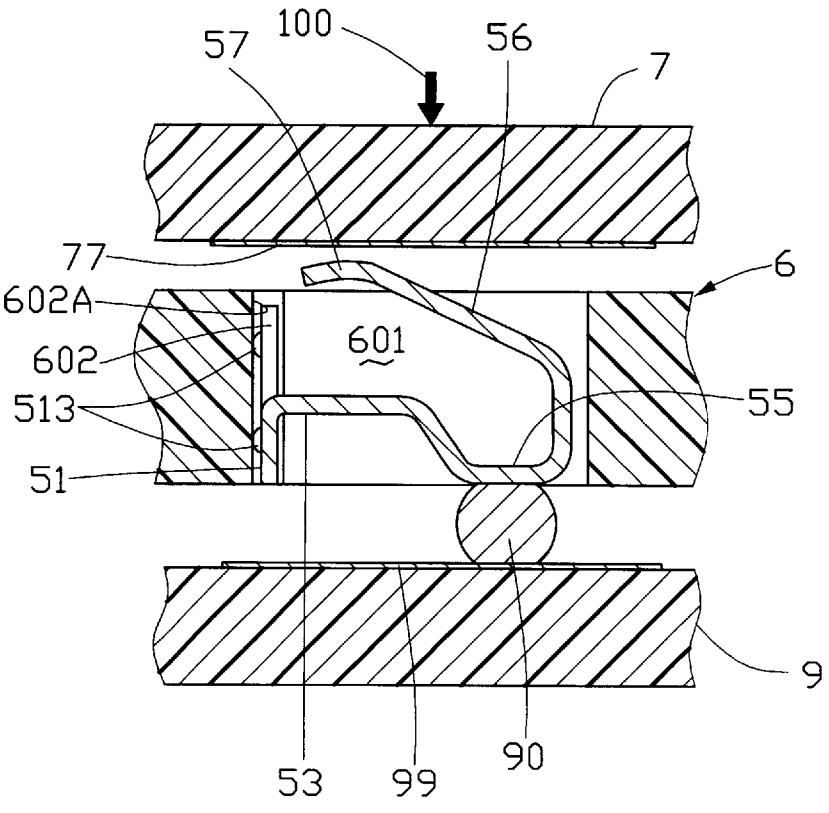
FIG. 6 is a schematic view showing that the connector of the present invention has been mounted on a printed circuit board while not yet surged by an IC package.

Referring to FIGS. 5 and 6, the CPU package 7 has a plurality of contact pads 77 (only one is shown for simplicity) and the printed circuit board 9 also has a plurality of contact pads 99 (only one is shown) and each pair of contact pads 77, 99 are arranged to register with each other when the CPU package 7 and the printed circuit board 9 sandwich the connector. The contact 5 comprises a U-shaped engagement plate 51, a first curved neck 52 extending from the U-shaped engagement plate 51, a first positioning section 53 connected to the first curved neck 52, a slope section 54 connected to the first positioning section 53, a second positioning section 55 connected to the slope section 54, a second curved neck 56 connected to the second positioning section 55, and a contacting section 57 connected to the second curved neck 56 with an upper apex upwardly extending out of the top surface of the housing 6. The first curved neck 52 and the second curved neck 56 are made relatively narrow for increasing their flexibility. The contacting section 57 is located in the highest position of the contact 5 extending beyond a very upper portion of the passageway 60 and the second positioning section 55 is located in the lowest position of the contact 5 substantially registering with a very lower portion of the passageway 60.

The U-shaped engagement plate 51 has two vertical sections 511 connected by a horizontal section 512. Each vertical section 511 has a tapered head 514 for facilitating loading of the contact into the passageway 60 from a bottom direction. Each vertical section 511 has two protrusions 513 formed by stamping and projecting outward for engagement with an inner wall 602A adjacent the lateral hole 602 by interference. The engagement between the contact 5 and the passageway 60 is a loose engagement, i.e., the engagement may be destroyed by a predetermined force either applied on the contact 5 or on the housing 6. Therefore, the housing 6 may move with respect to the contact 5 when it receives a predetermined force. The first curved neck 52 extends upward from the center of the horizontal section 512 and then bent for substantially 90 degrees. The first positioning section 53, the second positioning section 55, and the contacting section 57 retain parallel to each other and the first positioning section 53 is located in a horizontal position between the horizontal positions of the contacting section 57 and the second positioning section 55.

Particularly referring to FIG. 6, a solder ball 90 is soldered onto the second positioning section 55 in advance and defines a lower apex downwardly extending out of the bottom surface of the housing 6 so as to be then soldered onto a solder pad 99 of the printed circuit board 9. With this structure, the connector can be fixed on the printed circuit board 9 in advance via the solder balls 90.

Figure 7:
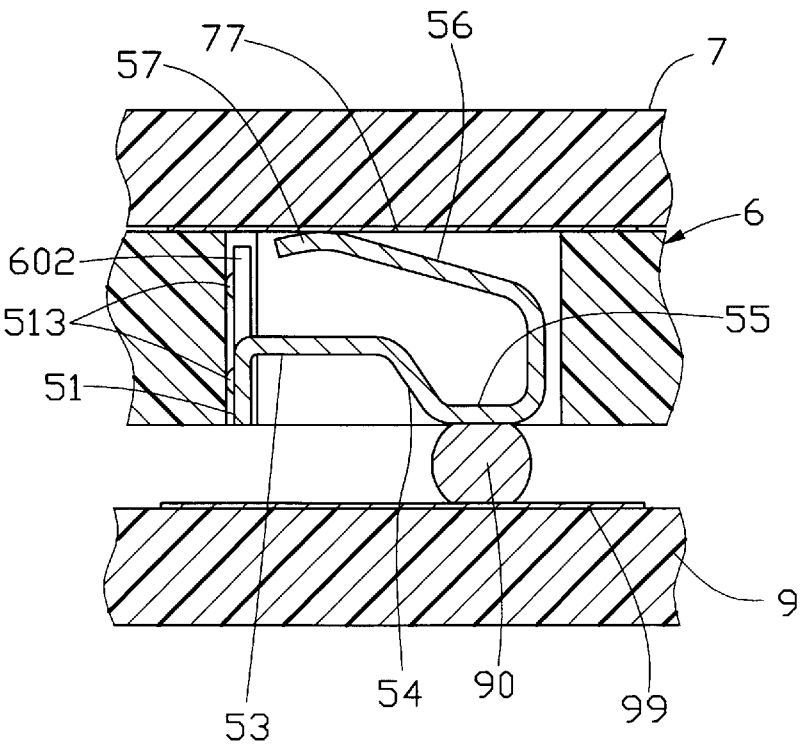
FIG. 7 is a schematic view showing that the connector has been urged by an IC package.

Referring to FIG. 7, the CPU package 7 having a plurality of contact pads 77 (only one is shown) is urged to the contacting sections 57 of the connector in a direction 100 and each second curved neck 56 is deformed to force the contacting section 57 to abut against the contact pad 77 of the CPU package 7 so that each contact pad 77 of the CPU package 7 is electrically connected to a corresponding one of the solder pads 99 of the printed circuit board 9 via the contact 5.

If low profile is required, the solder ball 90 may be soldered onto the first positioning section 53 and then the CPU package 7 may be urged to the connector. It is easier to surface mount the solder ball 90 onto the second positioning section 55 rather than mount it onto the first positioning section 53 because the second positioning section 55 directly exposes to external from the passageway 60 while the first positioning section 53 is located inside the passageway 60. Therefore, in the present embodiment, the solder ball 90 is mounted to the second positioning section 55.

Figure 9:
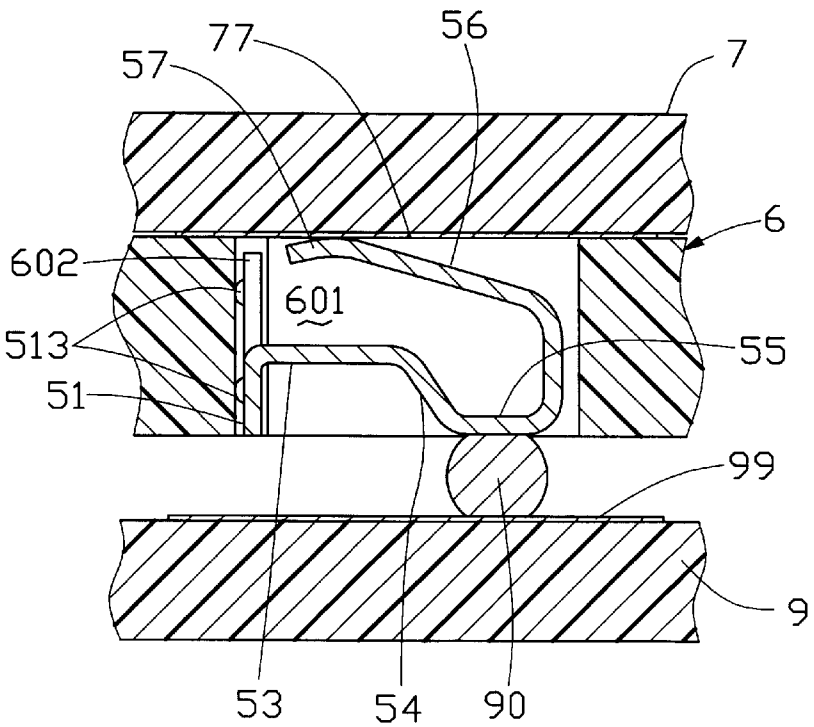
FIG. 9 is a schematic view showing that the warped housing and the contact surrounded thereby have been urged by an IC package.
Figure 8:
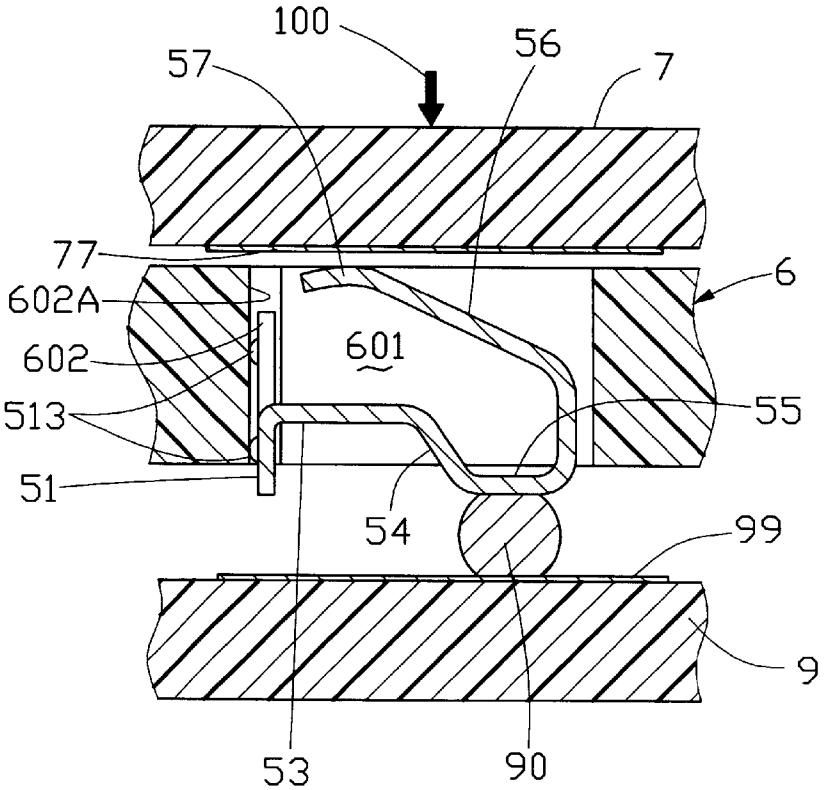
FIG. 8 is a schematic view similar to FIG. 6 except that the housing thereof is warped and incorrectly surrounds the contacting section of the contact.
Figure 10:
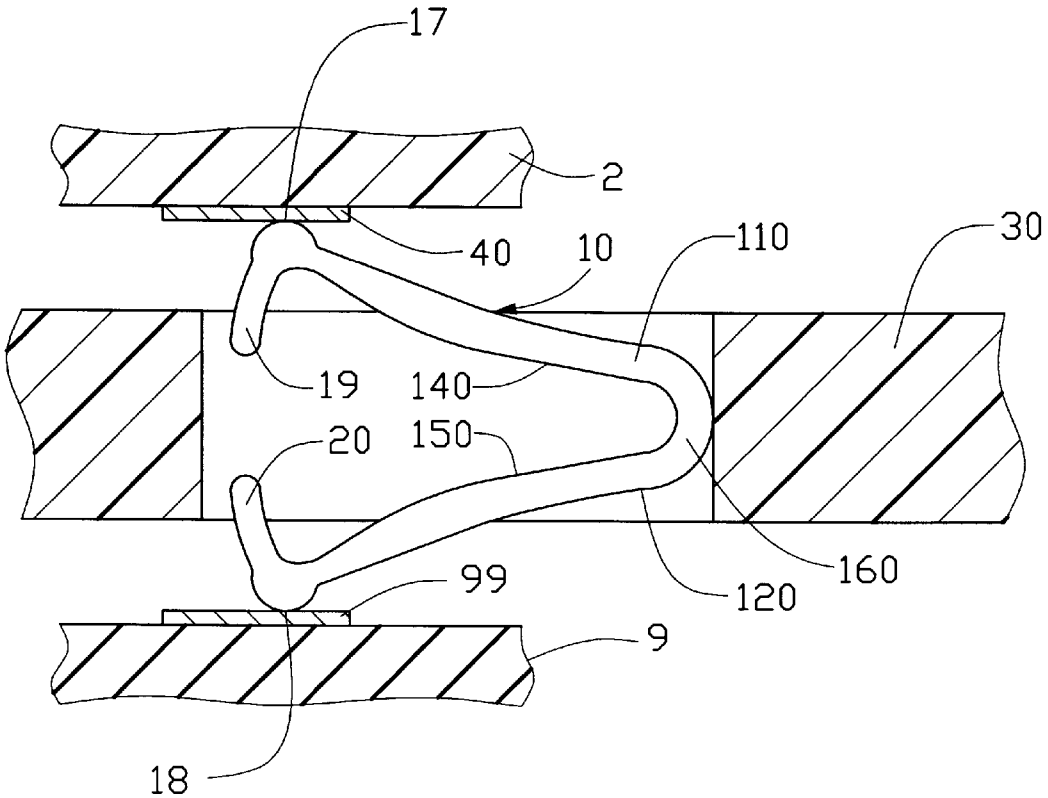
FIG.10 (PRIOR ART)
FIG. 10 is a schematic view of a conventional LGA connector sandwiched between an IC package and a printed circuit board.

FIGS. 6 and 7 illustrate the ideal situation of the LGA connector. However, in practice, the housing 6 is apt to be warped during manufacturing due to its low profile and large area. In other words, the housing 6 is made too thin to retain plain. A worst situation is shown in FIG. 8, wherein the contacting section 57 of the contact 5 after loaded into the passageway 60 can not extend beyond the passageway 60 which may prevent the contacting section 57 from being effectively contacted with by the contacting pad 77 of the CPU package 7 if the housing 6 is not able to move with respect to the contact 5. For effectively solving this problem, the housing 6 is made movable with respect to the contact 5. Since the protrusions 513 do not limit the contact 5 to move up or down in the passageway 60 when the contact 5 receives a predetermined force, the housing 6 may move down with respect to the contact 5 when urged by the CPU package 7. Referring to FIG. 9, the housing 6 is moved down to expose the contacting section 57 and the second curved neck 56 is deformed to provide a normal force for the contacting section 57 to abut against the contacting pad 77 of the CPU package 7 after the connector is urged by the CPU package 7.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A connector comprising an insulative housing in which a plurality of passageways are defined;

a plurality of contacts being received in the passageways;

each contact comprising an engagement plate loosely retained in the passageway, a positioning section connected to the engagement plate via a first flexible neck and mounted thereon a solder ball, a contacting section located above the positioning section and connected to the positioning section via a second flexible neck, wherein when the solder ball is soldered on a printed circuit board and the housing and the contact is urged by an external electrical device, the housing is moved downward with respect to the engagement plate of the contact and the contacting section is pressed downward by the external electrical device, with the second flexible neck being deformed for providing a normal force facilitating the contacting section to abut against the external electrical device;

wherein each passageway has a longitudinal hole and a lateral hole communicating with and perpendicular to the longitudinal hole;

wherein the engagement plate of the contact is loosely retained in the lateral hole of the passageway;

wherein the engagement plate is a U-shaped structure having two vertical sections connected by a horizontal section and the first flexible neck extends from a center portion of the horizontal section;

wherein each vertical section of the engagement plate has at least one protrusion extending therefrom for loosely engaging with a wall facing the lateral hole;

wherein the positioning section of each contact is retained in a horizontal position.

2. The connector as claimed in claim 1, wherein the positioning section of each contact is located at the lowest position with respect to the contact.

3. The connector as claimed in claim 1, wherein the positioning section of each contact is located above a lowest point of the contact.

* * * * *